US006702292B2

(12) United States Patent
Takowsky

(10) Patent No.: US 6,702,292 B2
(45) Date of Patent: Mar. 9, 2004

(54) GAME BALL SYSTEM INCORPORATING MEANS FOR POSITION SENSING

(76) Inventor: Gary S. Takowsky, 8500 Wilshire Blvd., Suite 630, Beverly Hills, CA (US) 90211

( * ) Notice: Subject to any disclaimer, the term of this patent is extended or adjusted under 35 U.S.C. 154(b) by 98 days.

(21) Appl. No.: 09/764,669

(22) Filed: Jan. 18, 2001

(65) Prior Publication Data

US 2002/0094893 A1 Jul. 18, 2002

(51) Int. Cl.[7] ..... A63F 13/00

(52) U.S. Cl. ..... 273/348; 463/53; 463/7; 473/353; 273/317

(58) Field of Search ..... 473/351, 353, 473/453, 476; 463/7, 1–5, 49–57, 44; 273/317, 331, 348

(56) References Cited

U.S. PATENT DOCUMENTS 5,639,084 A * 6/1997 Kawasaki ..... 473/421
5,868,578 A * 2/1999 Baum ..... 473/453
6,011,466 A * 1/2000 Goldman ..... 473/353

OTHER PUBLICATIONS

Microsoft Bookshelf Basics–Dcitionary defintion of sensor, copyright 1992. pp. 1.*

* cited by examiner

*Primary Examiner*—Mark Sager
*Assistant Examiner*—Aaron Capron
(74) *Attorney, Agent, or Firm*—Tope McKay & Associates; Cary Tope McKay; Marcus Risso

(57) ABSTRACT

A game ball system is presented including a ball, a means for position sensing for determining and producing information regarding the ball's position, an input device to receive user input, a processor connected with the means for position sensing and the input device to receive the information representing ball's position. The processor is also configured to receive the user input, and to process the information representing the ball's position and the user input according to a set of game rules to generate game output messages, which are outputted to the user via an output device in a user-understandable form. In operation, when a user tosses the ball upward, the processor receives a combination of user input and information about the ball's position, and processes them according to a set of game rules, providing feedback to the user regarding the game in the form of output messages from the output device.

16 Claims, 4 Drawing Sheets

GAME BALL SYSTEM INCORPORATING MEANS FOR POSITION SENSING

TECHNICAL FIELD

The present invention relates to toys and games that simulate sporting events. In particular, the present invention provides a ball-based game that incorporates a means for determining the ball's height as it is tossed substantially vertically.

BACKGROUND

Sporting event simulations allow players to experience a wide variety of sports and to become more involved with sports of which they are fans. Many people have neither the talent nor the desire to devote the time necessary to achieve a high level of athletic proficiency. Additionally, for some people, such as the handicapped, participation in many sports is impossible.

The use of devices to simulate sports play is a long-standing concept. Early games developed to simulate sports have include arcade-type games such as air-hockey, batting cages, and basketball hoop-shooting games. In addition, games with no direct analog to sports have been used to simulate the rules of various sporting events, such as the use of dart boards and lawn darts to simulate baseball and golf-type rules in order to give the player a feeling that they were actually playing the underlying sporting event.

More recently, video games have been developed that allow a player to simulate sporting events without physically playing a sport. Existing video games include titles which simulate virtually every sport, including football, soccer, baseball, basketball, hunting, fishing, skiing, martial arts, hockey, boxing, and rowing. Video games allow participants to control virtual players through the use of various input devices such as joysticks, keyboards, trackballs, and control pads.

The present invention provides another method for simulating various sports by using a ball having a means for detecting its altitude in relation to the player or, in the alternative, a means for detecting its position relative to a fixed plane or reference point.

SUMMARY OF THE INVENTION

It is a primary object of the present invention to provide a game ball system including a ball; a means for position sensing for determining the position of the ball and for producing information representing the position of the ball; an input device to receive user input; a processor communicatively connected with the means for position sensing and the input device to receive the information representing the position of the ball from the means for position sensing, to receive the user input from the input device, and to process the information representing the position of the ball and the user input according to a set of game rules to generate game output messages; and an output device communicatively connected with the processor to receive output game messages therefrom, and to present the messages in a user-understandable form. In operation, when a user tosses the ball upward, the processor receives a combination of user input and information about the position of the ball, and processes them according to a set of game rules, providing feedback to the user regarding the game in the form of output messages provided by the output device.

It is another object of the present invention to provide an input device therein which further comprises a means for receiving game rules, and wherein the processor uses game rules inputted through the input device to control the behavior of the game.

It is another object of the present invention to incorporate the means for position sensing, the input device, the processor, and the output device into the ball.

It is still another object of the present invention to provide an altimeter as the means for position sensing, and to incorporate it into the ball.

It is another object of the present invention to provide a means for position sensing selected from the group consisting of an altimeter, a camera/object recognition device, and a plurality of motion sensors disposed vertically along a wall.

It is another object of the present invention to provide an output device selected from the group consisting of an audio output device, a digital readout, and a plurality of lights.

It is yet another object of the present invention to provide a means for receiving game rules from a cartridge-type media.

It is still another object of the present invention that the processor generates game information, and wherein the system further comprises a persistent memory communicatively connected with the processor to store game information between games. It is also desirable that the game information includes player statistics and that a user may affect the storage of game information between games via the input device.

It is another object of the present invention that the means for position sensing includes a plurality of motion sensors disposed at varying heights, and where the ball is configured to trigger the motion sensors when it is tossed through one of the varying heights, and to register the greatest height reached with the processor, and where each of the varying heights represents a game event.

It is another object of the present invention that the means for position sensing is a camera/object recognition device positioned to view the ball as a user tosses it, to recognize the ball, to determine the height to which the ball is tossed, and to provide output including the height to which the ball is tossed.

It is still another object of the present invention that the means for position sensing is configured to determine the ball's height relative to a ceiling and to determine if the ball has impacted the ceiling.

DETAILED DESCRIPTION

The present invention relates to a ball-based game wherein a sensing system is provided to determine the vertical height to which a ball is tossed, and may be tailored to a variety of applications. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

Figure 1:
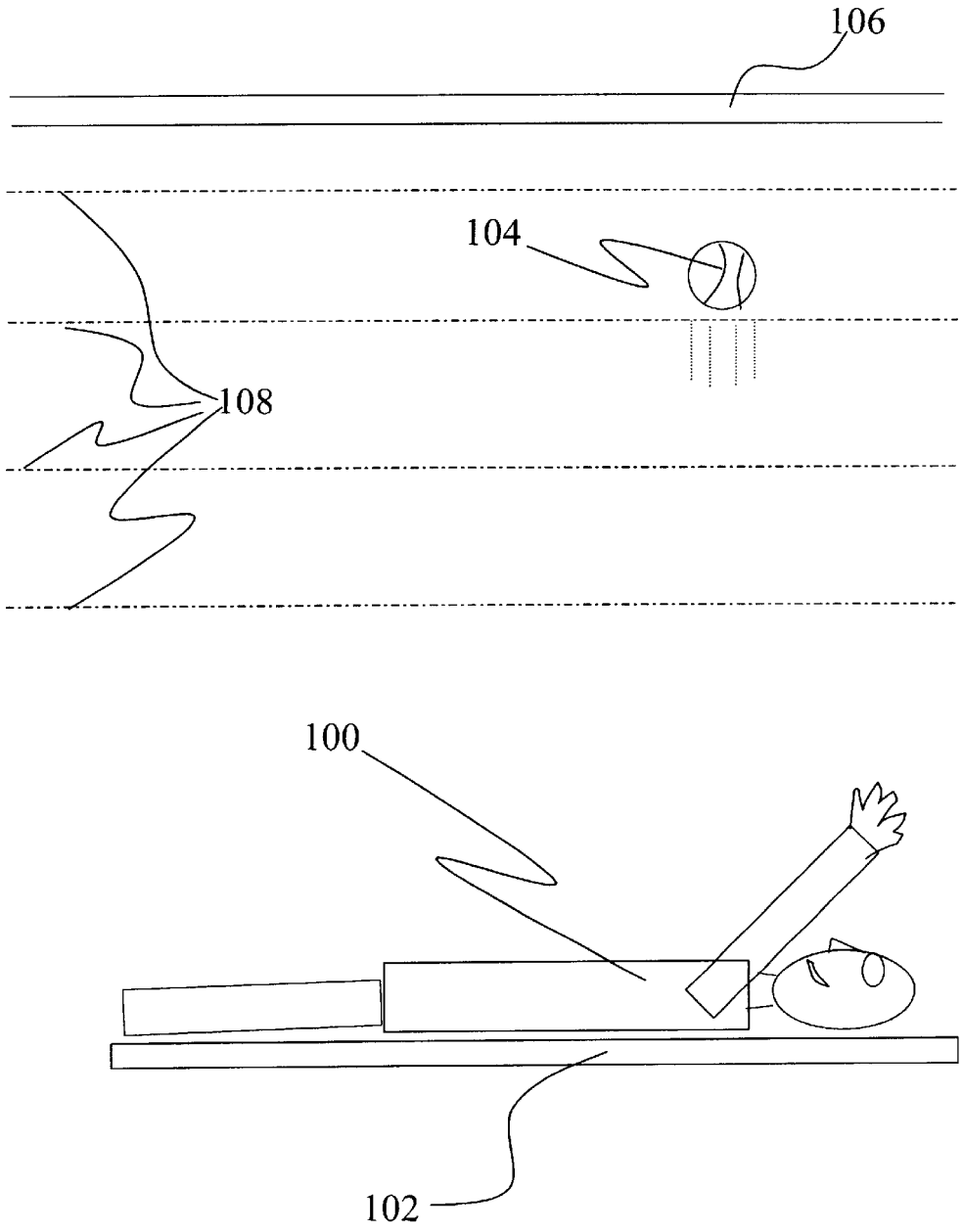
FIG. 1 provides a schematic representation of a game in play incorporating an embodiment the present invention.

An example of a game played using an embodiment of the present invention is shown in FIG. 1. The illustration shown in FIG. 1 is presented to provide an overview of a possible embodiment of the present invention, and to assist in providing an understanding of its function. However, as will become clearer with regard to subsequent figures, the exact arrangement of the components of the present invention is subject to a variation. In this embodiment, a player 100 is shown lying down on a surface 102. In play, the player 100 activates the ball 104 and tosses it toward the ceiling 106. In this embodiment, the ball 104 includes a means for position sensing to determine how close to the ceiling it reaches. Generally, the means for position sensing determines the height to which the ball 104 is tossed, and can be calibrated such that given the ceiling height and the height to which the ball 104 is tossed, the distance between the ball and ceiling can be calculated. In this example, the goal of the player 100 is to toss the ball 104 as close as possible to the ceiling 106 without actually causing the ball 104 to contact the ceiling 106. Generally, the closer the ball 104 comes to reaching the ceiling 106 without touching it, the higher the score awarded to the player 100. Various height thresholds 108 for the ball 104 are set, and depending on the game simulated, various height-based rules may be utilized. For example, in a simulated game of baseball, there may be several height thresholds 108, indicating game events such as singles, doubles, triples, or home runs as well as outs, balls, strikes, and fouls. The ball 104, in this embodiment, contains electronic circuitry that tracks the player's success and incorporates game rules to allow for the simulation of a game. Depending on the specifics of the particular embodiment, a single game may be incorporated into a processor in the ball 104, or cartridges or other similar media may be provided to allow a player 100 to switch games. The position of the ball 104 may be measured by various position detection means such as a calibrated altimeter, a magnetic sensor along a wall and on the ceiling, a camera/object detection device, or a light sensing means. In addition to determining the distance from the ceiling 106, an embodiment of the present invention incorporating an altimeter could be used in a variation of the game where players 100 throw the ball 104 into the air to see who can achieve the highest throw.

Figure 2:
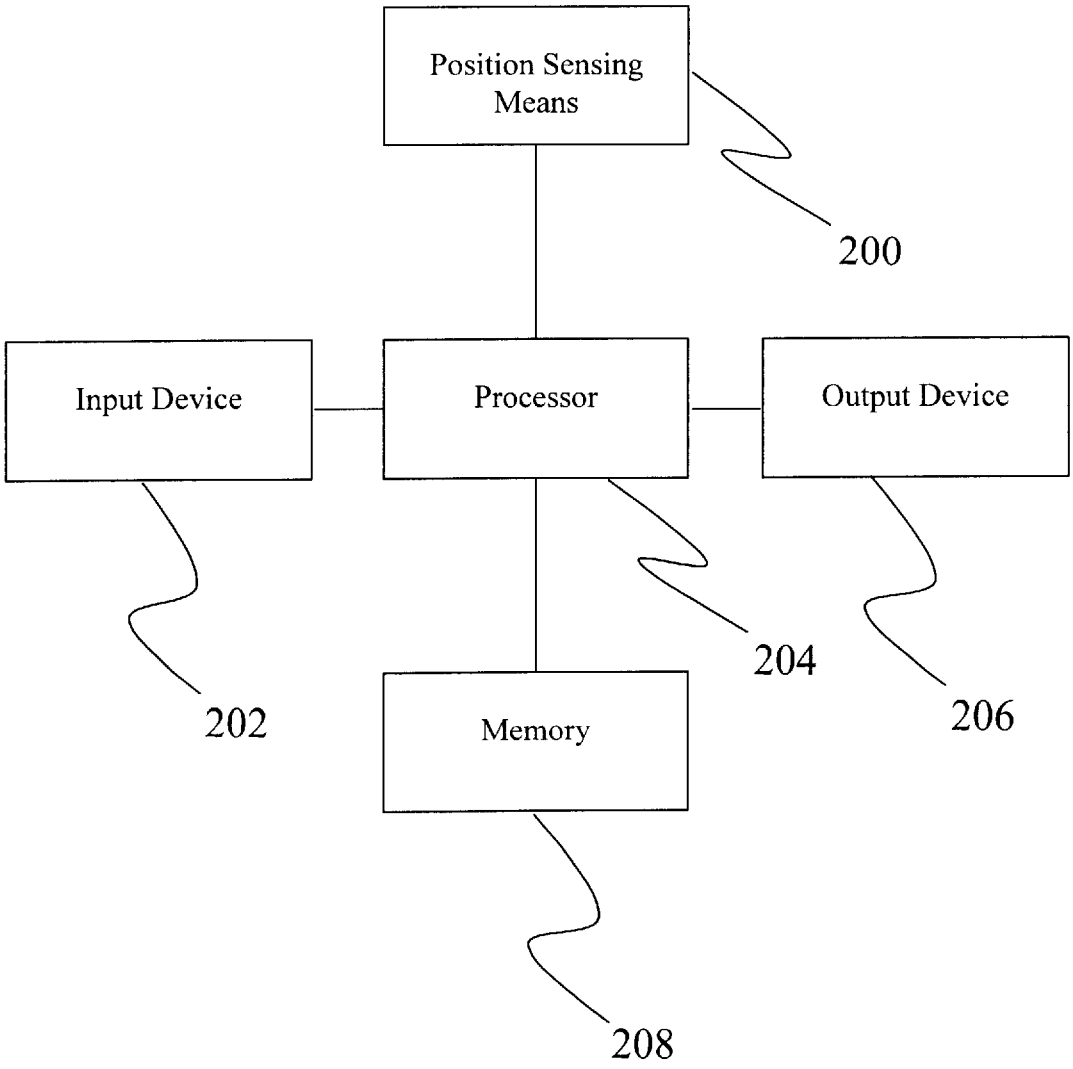
FIG. 2 provides a system diagram with the general components of the present invention.

A general system view of the present invention is shown in FIG. 2. As shown, the system includes a means for position sensing 200, an input device 202, a processor 204, an output device 206, and a memory 208. Note a general form, the system may either be incorporated in the ball 104, or it may be distributed across several components external to the ball. In the preferred embodiment, all of the components in the system are incorporated in the ball 104. The means for position sensing 100 keeps track of the ball's height. In the preferred embodiment, the means for position sensing 100 is a finely calibrated altimeter residing in the ball 104. Other embodiments of the means for position sensing include the use of a series of light sensors/emitters, which could incorporate the use of a specific wavelength such as infrared, and which could be set up to create a series of detection layers set at desired heights, whereby when the ball passed through a layer, its presence at the particular layer height could be detected and registered, with the highest layer height achieved ultimately being provided to the processor 204. The input device 202, in a basic form, is used to power the electronics and to start the game. It can also be used to control the game settings such as setting game difficulty, resetting the game, changing players in multiple-player games, resetting high scores, and possibly for storing and deleting players, should the game allow. Furthermore, depending on the specific embodiment, the input device 202 could also be configured to accept game cartridges or other media that allows for changing the game rules. The processor 204 is communicatively connected to receive commands from the input device 202 and to process them in light of the game rules and other operations allowed by the particular embodiment. The output device 206 is communicatively connected with the processor to generate output regarding the game. The output device 206 typically comprises audio, visual, and/or mechanical feedback system that alert the player 100 to various game events and conditions. For example, in a game of baseball, when the player 100 tosses the ball 104 to an appropriate height (or distance from the ceiling) to score a triple, the ball could generate a sound alerting the player 100 to what they have just done. An audio signal could include, as a non-limiting example, a series of beeps, music, and vocal sounds, such that when initialized, the game could say "let's play ball" followed by traditional baseball music. Similar sounds could be incorporated for the various game events. In the case of a visual alert, the game could provide a LCD or other type of display to let the player 100 see the current score as well as where they are in the current game. The memory 208, is communicatively connected with the processor, and depending on the embodiment specifics could take the form of either a persistent memory, such as a flash-type memory or of a temporary memory that only persists while the game is on, or a combination of both. For example, a temporary memory may be desirable where the game only performs memory-requiring operations during play, whereas a persistent memory may be desirable in situations where the game keeps track of high scores and other player data.

In use, the means for position sensing 200 could take many forms. Currently, small altimeters are becoming increasingly accurate, and could be used within the ball to capture the highest point in a toss. Also, an array motion detectors placed at varying heights along a wall and configured to detect the ball 104 as it is tossed substantially vertically, could be used to register the height to which the ball 104 is tossed. Furthermore, current optical technologies could be employed, including a camera/object recognition device. The camera/object recognition device may be placed and configured such that the ball toss is within the field of view of the camera, and such that the height to which the ball 104 can be determined. Setting a distance between the camera and the ball 104, and providing the appropriate height thresholds for the various game events will allow the system to determine the maximum height reached by the ball 104. Additionally, it may be desirable to color the ball surface to maximize the ability of the camera/object recognition device to "see" the ball. Furthermore, the camera/object recognition device may detect a collision between the ball 104 and a ceiling 106 by detecting the sharp deceleration that would occur at impact.

The various components that make up the system may be connected electronically by hard-wiring, or may be connected via a wireless connection such as radio or infrared. Radio connections could be used, for example, in cases where a portion of the circuitry resides in the ball and a portion resides external to the ball. The connections between the various components may be tailored and optimized for a particular embodiment.

Figure 3:
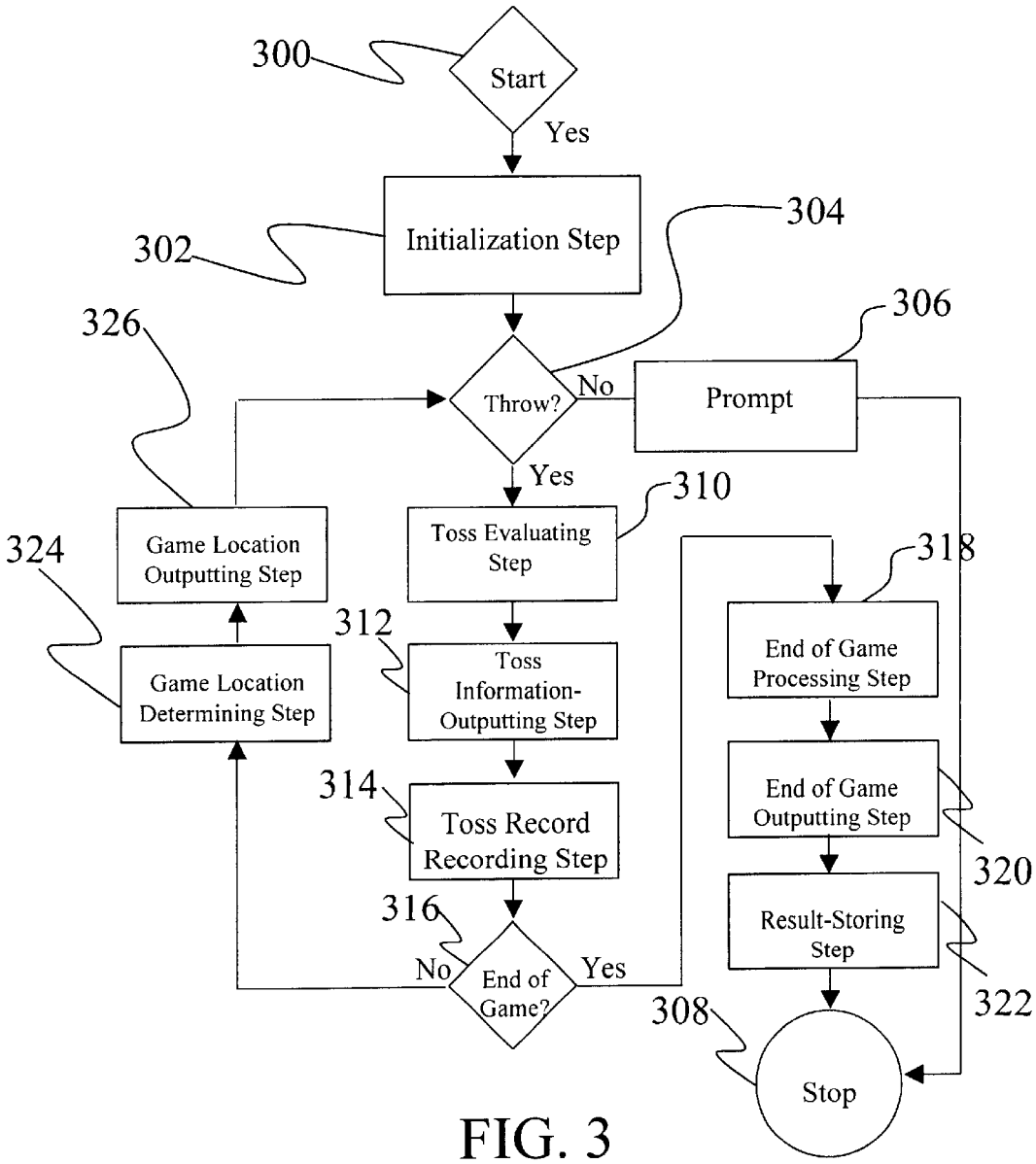
FIG. 3 provides a general flow diagram of the operation of an embodiment of the game of the present invention with an emphasis on use for simulating a baseball game.

A general flow diagram of a game process utilized by the present invention is provided in FIG. 3. Initially, it is assumed that the system is turned off or inactive, and awaits initialization in a start step 300. In a typical embodiment of the present invention, activation would take place via a start button or switch. Once the system has been activated, the system power is turned on, a game is initialized, and the player 100 is prompted for a throw in an initialization step 302. The system then awaits a throw 304 from the player 100. If the player 100 delays throwing the ball, the system will prompt the player 100 to throw the ball in an optional prompting step 306. After the prompting step 306, the system will stop and power down in a stopping step 308. If the player 100 throws the ball 104, the system will determine the height of the ball (or its distance from the ceiling, depending on the rules of the particular game), and will evaluate the toss height via the rules to determine what game event (i.e. a single, double, home run, etc. in an embodiment simulating baseball) occurred in a toss evaluating step 310. After the toss has been evaluated and the appropriate game event determined, the system will output information regarding the game event to the player 100 in a toss information-outputting step 312. After the toss information has been outputted to the player 100, information regarding the toss that is necessary for the game is recorded into memory during a toss record recording step 314. It is important to note that although shown and discussed here as occurring after the toss information-outputting step 312 that the toss record recording step 314 could take place before, during, or after the toss information-outputting step 312. After the toss information-outputting step 312 and the toss record recording step 314, the game rules are checked to determine if the game is over or whether it is to continue in an end of game checking step 316. If it is determined that the game should be finished, final statistics such as a final score are calculated in an end of game processing step 318. Next, final information regarding the game is presented to the player 100 in an end of game outputting step 320. Note that in addition to simply outputting the score and other information, the end of game outputting step 320 could also include the provision of a final game song and vocal prompts such as "care to play again?". Finally, the results of the game are stored in an optional result-storing step 322. The presence of the result-storing step 322 depends on the particular configuration of the system, i.e. whether it has a persistent memory. If it was determined that the game was to continue in the end of game checking step 316, the current location in the game is determined from the rules in a game location determining step 324. This step enables the system to keep track of where the player 100 is in the course of the game. For example, in a baseball game, it would keep track of the number of outs and the inning so that the player 100 could make progress toward the end of the game. Next, in an optional game location-outputting step 326, the location within the game is outputted to the player 100. For example, in a baseball game, the player 100 may hear "strike two, out two, inning four". This would allow the player 100 to know exactly how far they are progressing toward the end of the game. Next, the game awaits a throw 304, and the game continues.

Figure 4:
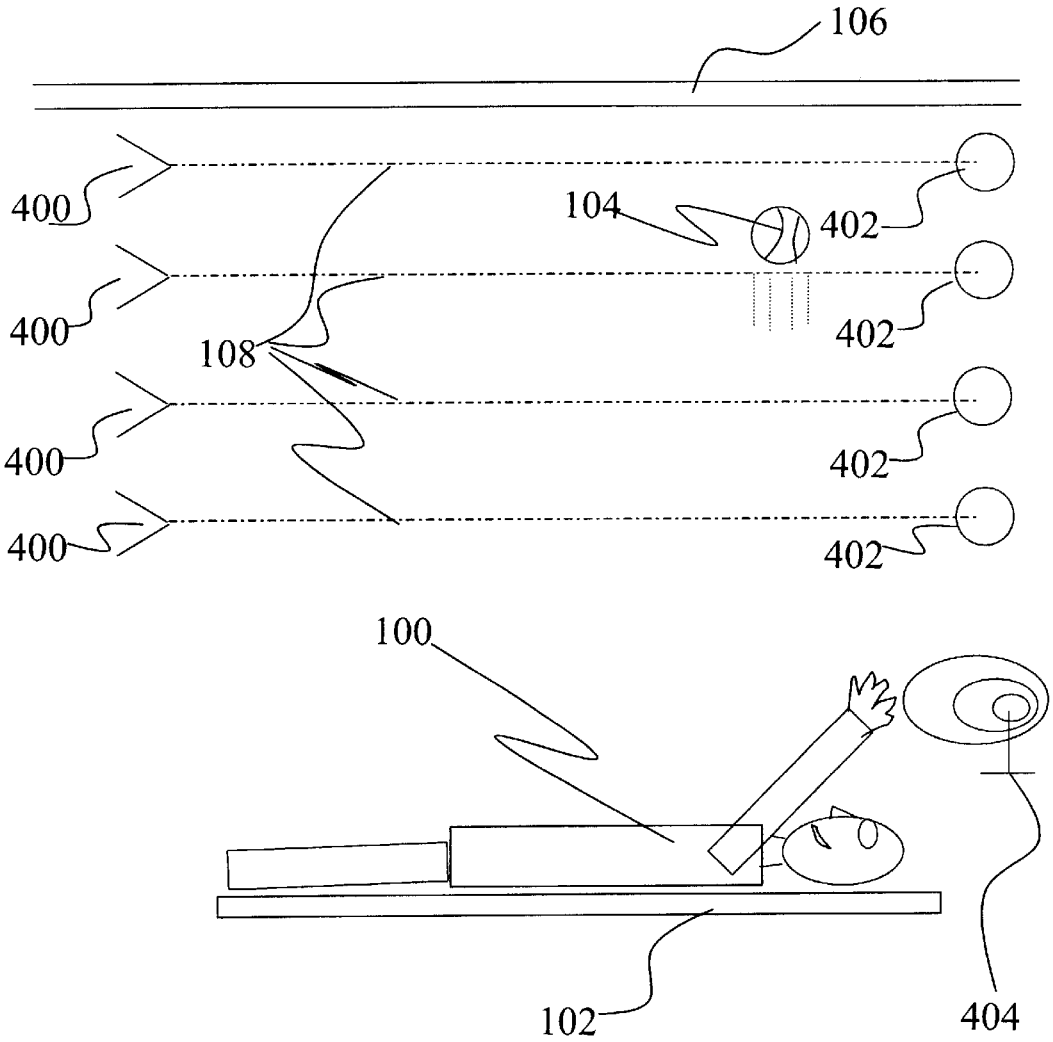
FIG. 4 provides a schematic representation of the layout of sensors for an embodiment of the present invention incorporating a means for position sensing comprising a directional infrared or light projection/detection means.

A schematic view of an alternate embodiment of the present invention is shown in FIG. 4, wherein the means for position sensing comprises a plurality of transmitters 400 and receivers 402, set in pairs at various heights between the user 100 and the ceiling 106. Each transmitter 400 and receiver 402 pair create a height threshold 108, with each height threshold determining a game event. The transmitter 400 and receiver 402 in this embodiment typically comprise a light transmitter and receiver operating in the infrared wavelengths. It is important to note that any suitable wavelength could be selected in this case. The light passing from the transmitters 400 to the receivers 402 preferably passes in a sufficiently planar path, such that only only a desired receiver 402 receives light from only one transmitter 400. In operation, as the ball 104 is tossed, and passes through the varying height thresholds 108, a signal is provided to the processor 204, which indicates the highest height threshold 108 intruded by the ball 104. This may be accomplished by setting a timer to count only the highest height threshold 108 entered within a given time frame. In this embodiment, the system components are distributed, and the system components may be partially within the ball 104 or wholly external. If a portion of the system components is in the ball 104, a transmitter 404 must be provided for height information to be sent to the ball 104. In addition, a receiver must be incorporated in the ball and connected with the processor 204.

Alternative designs to the embodiment shown in FIG. 4 could easily be derived, including embodiments wherein the light receivers 402 are incorporated into the ball 104 so that a transmitter 404 and receiver are not required to pass height information to the processor 204 of the ball 104. The inventor anticipates that many combinations of the elements of the present inventions are readily achievable, and are thus within its scope. In addition to altimeters and light transmitters 400 and receivers 402, other height detection schemes could be used, examples of which could include magnetic field generators and detectors, among others.

What is claimed is:

1. A game ball system for using the height to which a ball is thrown to trigger game events, the system including;

a. a means for position sensing for determining the position of a ball and for producing information representing the position of the ball;

b. where the means for position sensing is a plurality of motion sensors disposed at varying vertical heights, with each motion sensor in the plurality of motion sensors accounting for a vertical zone of scoring in order to detect an upward trajectory of a ball passing through the vertical zones of scoring;

c. an input device to receive user input;

d. a processor communicatively connected with the means for position sensing and the input device to receive the information representing the position of the ball from the means for position sensing, to receive the user input from the input device, and to process the information representing the position of the ball and the user input according to a set of game rules for scoring tosses with an upward trajectory as the ball passes through the vertical zones of scoring to generate game output messages; and e. an output device communicatively connected with the processor to receive the game output messages therefrom, and to present the messages in a user-understandable form, whereby when a user tosses the ball upward, the processor receives a combination of user input and information about the position of the ball, and processes the information according to a set of game rules for scoring tosses with an upward trajectory as the ball passes through vertical zones of scoring, providing feedback to the user regarding a game in the form of output signals provided by the output device.

2. A game ball system as set forth in claim 1, wherein the input device further comprises a means for receiving game rules, and wherein the processor uses game rules inputted through the input device to control the behavior of the game.

3. A game ball system asset forth in claim 2, wherein the means for receiving game rules receives rules from a cartridge-type media.

4. A game ball system as set forth in claim 1, wherein the game ball system further includes a ball, and wherein the means for position sensing, the input device, the processor, and the output device are all incorporated into the ball.

5. A game ball system as set forth in claim 4, wherein the means for position sensing is an altimeter.

6. A game ball system as set forth in claim 1, wherein the means for position sensing is selected from the group consisting of a camera/object recognition device and a plurality of motion sensors disposed vertically along a wall.

7. A game ball system as set forth in claim 1, wherein the output device is selected from the group consisting of an audio output device, a digital readout, and a plurality of lights.

8. A game ball system as set forth in claim 1, wherein the processor generates game information, and wherein the system further comprises a persistent memory communicatively connected with the processor to store game information between games.

9. A game ball system as set forth in claim 8, wherein the game information includes player statistics.

10. A game ball system as set forth in claim 8, wherein the user may affect the storage of game information between games via the input device.

11. A game ball system as set forth in claim 1, wherein the means for position sensing includes a plurality of motion sensors disposed at varying heights, and where the ball is configured to trigger the motion sensors when it is tossed through one of the varying heights, and to register the greatest height reached with the processor, and where each of the varying heights represents a game event.

12. A game ball system as set forth in claim 1, wherein the means for position sensing is a camera/object recognition device positioned to view the ball as the user tosses it, to recognize the ball, to determine the greatest height to which the ball is tossed, and to provide output including the height to which the ball is tossed.

13. A game ball system as set forth in claim 1, wherein the means for position sensing is configured to determine the ball's height relative to a ceiling and to determine if the ball has impacted the ceiling.

14. A game ball system including:

a. a ball;

b. a plurality of motion sensors disposed vertically at varying heights, each representing a game event along a wall, and where the ball is configured to trigger the motion sensors when it is tossed through one of the varying heights, with each motion sensor in the plurality of motion sensors accounting for a vertical zone of scoring in order to detect an upward trajectory of a ball passing through the vertical zones of scoring and where the plurality of motion sensors provides an output including the greatest height reached by the ball;

c. an input device to receive user input and game rules;

d. a processor communicatively connected with the plurality of motion sensors and the input device to receive the output representing the greatest height reached by the ball from the plurality of motion sensors, to receive the user input from the input device, and to process the information representing the position of the ball and the user input according to the game rules for scoring tosses with an upward trajectory as the ball passes through the vertical zones of scoring to generate game output messages;

e. a persistent memory communicatively connected with the processor to store game information between games, said game information including player identification and player-specific game statistics;

f. an output device communicatively connected with the processor to receive the game output messages therefrom, and to present the messages in a user-understandable form, whereby a user may configure the game through the input device, and when the user tosses the ball upward, the processor receives a combination of user input and information about the position of the ball, and processes the information according to a set of game rules for scoring tosses with an upward trajectory as the ball passes through the vertical zones of scoring, providing feedback to the user regarding the game in the form of output signals provided by the output device.

15. A game ball system for using the height to which a ball is thrown to trigger game events, the system including:

a. a camera/object recognition device positioned to view a ball as it is tossed vertically by a user and to determine the height of the ball, and to provide an output including the greatest height reached by the ball during the toss;

b. where the camera/object recognition views the ball at varying vertical heights, with each varying vertical height accounting for a vertical zone of scoring in order to detect an upward trajectory of a ball passing through the vertical zones of scoring;

c. an input device to receive user input and game rules;

d. a processor communicatively connected with the camera/object recognition device and the input device to receive the information representing the greatest height reached by the ball from the plurality of motion sensors, to receive the user input from the input device, and to process the output of the camera/object recognition device and the user input according to the game rules for scoring tosses with an upward trajectory as the ball passes through the vertical zones of scoring to generate game output messages;

e. a persistent memory communicatively connected with the processor to store game information between games, said game information including a player identification and player-specific game statistics;

f. an output device communicatively connected with the processor to receive the game output messages therefrom, and to present the messages in a user-understandable form, whereby a user may configure the game via the input device, and when a user tosses the ball upward, the processor receives a combination of user input and information about the position of the ball, and processes them according to a set of game rules for scoring tosses with an upward trajectory as the ball passes through the vertical zones of scoring, providing feedback to the user regarding the game in the form of output signals provided by the output device.

16. A game ball system as set forth in claim 15, further including a ball configured such that the ability of the camera/object recognition device to detect the ball is optimized.

* * * * *